United States Patent [19]

Hanson

[11] Patent Number: 4,809,683

[45] Date of Patent: Mar. 7, 1989

[54] AID FOR CARDIO-PULMONARY RESUSCITATION

[76] Inventor: Carla Hanson, 21 Ross Street, Dryden, Ontario, Canada, P8N 1T9

[21] Appl. No.: 173,740

[22] Filed: Mar. 28, 1988

[51] Int. Cl.[4] ..... H61H 31/00

[52] U.S. Cl. ..... 128/28; 128/67; 128/54; 128/24 R

[58] Field of Search ..... 128/28, 54, 61, 62 R, 128/67, 112, 115, 60; 272/93, 68, 143; 2/20, 24

[56] References Cited

U.S. PATENT DOCUMENTS

| | | | |
|---|---|---|---|
| 1,713,756 | 5/1929 | Hassler | 128/62 R |
| 1,769,872 | 7/1930 | Weeks | 128/60 |
| 2,017,400 | 10/1935 | Höyer | 128/60 |
| 3,107,665 | 10/1963 | Nordgren | 128/60 |
| 4,019,501 | 4/1977 | Harris | 128/28 X |
| 4,077,400 | 3/1978 | Harrigan | 128/28 X |
| 4,355,634 | 10/1982 | Kanter | 128/28 |
| 4,421,110 | 12/1983 | DeLisle | 128/60 |
| 4,554,910 | 11/1985 | Lally | 128/28 |
| 4,621,808 | 11/1986 | Orchard et al. | 272/119 |
| 4,747,397 | 5/1988 | Magovern | 128/60 X |

FOREIGN PATENT DOCUMENTS

| | | | |
|---|---|---|---|
| 344528 | 11/1921 | Fed. Rep. of Germany | 128/60 |

*Primary Examiner*—Richard J. Apley
*Assistant Examiner*—Howard Flaxman
*Attorney, Agent, or Firm*—Adrian D. Battison; Stanley G. Ade; Murray E. Thrift

[57] ABSTRACT

An aid for cardio-pulmonary resuscitation comprises a flat disc having a lower surface coated with an adhesive suitable for application to the skin of a patient, the adhesive being covered by a removable film to allow the adhesive to be activated. The upper surface of the disc is covered by a moisture absorption layer and includes a peripheral rib. The size of the upper surface is sufficient just to receive the forward part of the palm of the operative and the forward rib is arranged to lift the fingers of the operative away from the patient's skin. The device is positioned at the start of the resuscitation process at the landmark position and remains in place during the process.

10 Claims, 1 Drawing Sheet

AID FOR CARDIO-PULMONARY RESUSCITATION

BACKGROUND OF THE INVENTION

This invention relates to an aid for use in cardio-pulmonary resuscitation.

Cardio-pulmonary resuscitation (C.P.R.) has become a widely used and accepted technique for victims of heart failure and can be credited with saving many lives. Very briefly it involves a technique in which hand pressure is applied to the chest of the patient at a location so as to apply direct pressure to the heart to provide a pumping action of the heart when the heart itself is not operating. The whole process also involves periodic inflation of the lungs of the patient so that the patient's heart and lung operations are maintained at a level to avoid damage to vital organs before the patient can be moved to a treatment center and the heart action restored by drugs or other treatment.

It is often necessary in a situation of complete heart failure to maintain the repeated compression strokes on the chest of the patient for a long period of time while the patient is transferred to a treatment center.

A number of problems arise when attempting to maintain the action over a considerable period of time. Firstly the exertion involved by the medical operative can be quite significant leading to sweating of the operative and/or the patient and tiring of the operative. The sweat can then act as a lubricant between the skin on the palm of the hand of the operative and the skin of the patient leading to the hand slipping from the required location. It will of course be appreciated that if the compression stroke is applied at the wrong location then firstly it does not generate the required pumping action of the blood in the heart and secondly it can cause severe damage to the rib bones of the patient. This slipping of the hand of the operative from the required place of course is exacerbated by tiredness.

Secondly it is necessary for the operative to remove their hand from the required location each time the lungs are to be inflated. In practice the compression strokes are applied at a rate of 1 stroke per second over fifteen strokes following which the lungs are inflated using in most cases mouth to mouth resuscitation techniques. It is then necessary for the operative having moved to inflate the lungs to return to the patient's chest and again to locate the required position for the compression strokes.

Thirdly the operative during a compression stroke is required to keep the fingers lifted away from the chest of the patient so that the compression stroke is applied strictly by the palm or forward part of the palm of the operative. This technique should if properly used avoid breaking the rib bones during the forceful compression stroke. However when the operative is tiring, it often occurs that the whole hand rests upon the patient's chest and the compression stroke is applied over a much bigger area thus reducing the effect of the stroke and significantly increasing the danger of damage to the patient's chest.

At the present time it is believed that no equipment is available on the market for assisting in resuscitation techniques of this type. Various complex machines and equipment may be available but these are not suitable for manufacture in large quantities at a cheap price so as to enable the product to be maintained at all sites where it may be necessary to be used.

U.S. Pat. No. 4,355,634 (Kanter) shows a block device which has an adhesive layer for attachment to the chest of the patient. The device is however relatively complex and bulky. While complex depth gauges may be desirable in a hospital setting, they are of no value in a "on the go" situation where a patient is being rapidly transported from a remote location to the hospital.

SUMMARY OF THE INVENTION

It is one object of the present invention therefore to provide a simple inexpensive device which can assist in the cardio-pulmonary resuscitation technique and yet is sufficiently inexpensive and simple to allow it to be stored or maintained in locations where it may be needed for example ambulances, first aid rooms and in first aid equipment.

According to the invention, therefore, there is provided an aid for use in cardio-pulmonary resuscitation of a patient by a medical operative comprising a thin disc member having a substantially planar lower surface, activatible adhesive means on said lower surface of a type suitable for attachment of the disc member to the patient's skin, the disc member having an upper surface sized to receive the palm area of the operative's hand, moisture absorption means on the upper surface and a raised rim at least partly surrounding the upper surface.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 3:
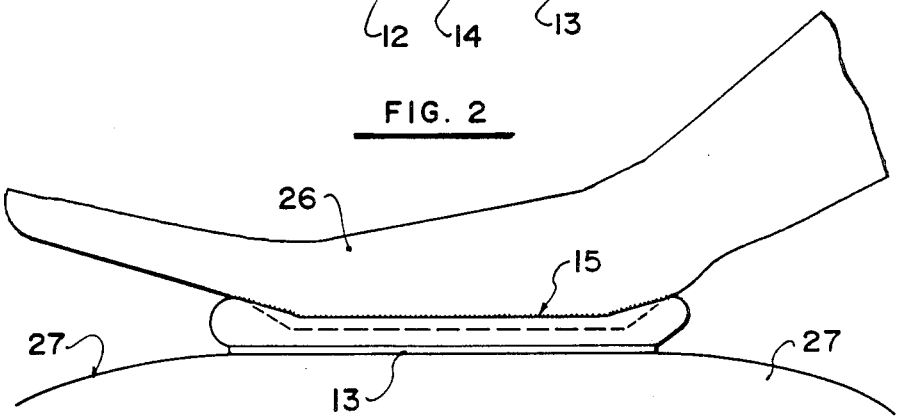
FIG. 3 is a cross sectional view similar to that of FIG. 2 showing the device attached to the skin of a patient and showing slightly modified design from that of FIG. 2.

The device comprises a flat disc member indicated generally at 10 which is approximately rectangular in shape defining an upper surface 11 which is of a size to substantially receive the palm area of the medical operative. In one example, therefore, the device can be of the order of four inches square defining an upper surface which is approximately four inches across and of the order of two and three quarter inches in a forward to rearward extent excluding the ribs described hereinafter. Such a rectangular area is sufficient to receive the palm area 26 of the average operative as shown best in FIG. 3.

The plate member is formed as a flat disc of thin plastics material for example nylon which has sufficient flexibility to avoid cracking when force is applied to the disc and to follow to some extent the shape of the patient's chest as it is compressed. Thus the disc defines an upper surface 11 and a lower surface 12 which are parallel and spaced only by the thickness of the disc which can in one example be of the order of one eighth inch.

Covering the whole of the lower surface of the disc is an adhesive layer 13 of a type which is suitable to provide adhesion between the disc and the skin 27 of a patient without causing damage to the skin. The adhesive must be of a type that the device can be removed from the patient after use without damaging the skin but provides sufficient adhesion so that it remains properly in place despite forces applied thereto during the cardio-pulmonary resuscitation technique.

The adhesive layer 13 is covered by a film or paper layer 14 which, prior to operation of the device, retains the adhesive layer inactive so that the device can be packed in suitable packaging, removed for operation and the film layer pealed away to expose or activate the adhesive.

Figure 1:
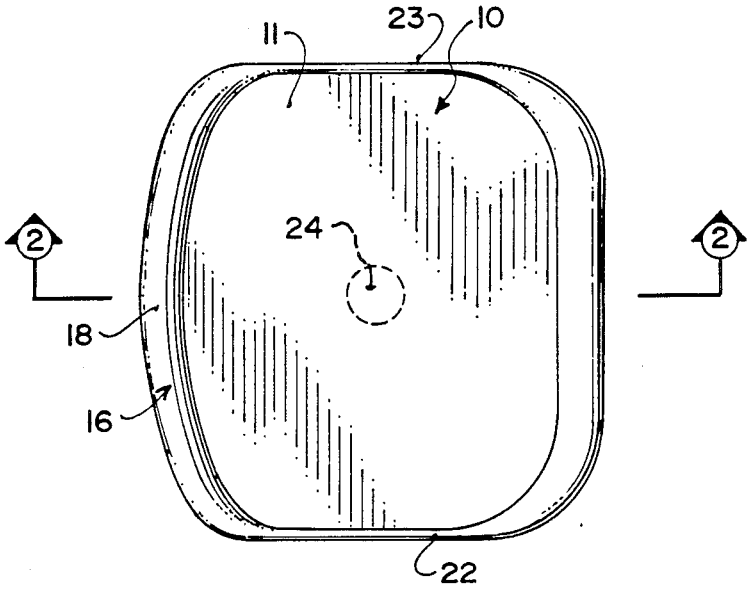
FIG. 1 is a top plan view of a device according to the invention.
Figure 2:
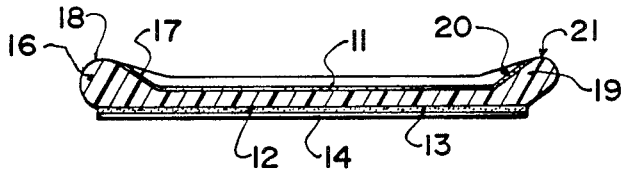
FIG. 2 is a cross sectional view along the lines 2—2 of FIG. 1.

The upper surface 11 of the device is formed from a suitable plastics material which has absorption properties to absorb any moisture developing by perspiration on the hand of the user. In the device shown in FIG. 2, this absorption layer is formed as an integral molding with the basic disc member using known molding techniques. In the embodiment shown in FIG. 3, the absorption layer is a separate layer indicated at 15 formed of a suitable absorbent foam or sponge which is applied to the disc after its molding.

Across a forward edge of the disc is provided a raised rib 16 which has a ramp surface 17 inclined upwardly from a forward edge of the upper surface 11 to an uppermost apex 18 of the rib. From the apex the rib curves smoothly as a semi-circle in cross section to join the lower surface 12.

A similar but slightly smaller rib 19 is provided across a rearward edge of the upper surface 11 defining again a ramp surface 20 and an apex 21. Along side edges of the upper surface is provided a similar pair of raised ribs 22 and 23.

In operation, the device is removed from any suitable packaging and the covering layer 14 removed from the adhesive 13. The landmark position is then located on the chest of the patient by conventional techniques and the device positioned on the chest of the patient at the landmark with a locating dot 24 at the center of the device more accurately defining the actual landmark point. The forward edge 16 of the device is presented away from the operative with the operative kneeling to one side of the patient. The operative then can place the hand on the upper surface with the base of the fingers resting upon the ramp surface 17. The forward rib 16 thus acts to hold the fingers of the operative away from the chest or skin of the patient providing a lifting action which ensures that the fingers, even when the operative is tired, cannot fall back downwardly onto the skin. The heel of the hand of the operative is similarly lifted away from the patient by the rearward rib 19. The ribs around the full periphery of the device thus act to prevent the hand from sliding forwardly, rearwardly or sidewardly and maintain the hand in the required position so that force is applied only over the area of the device itself which is limited to the forward part of the palm of the operative.

The absorption layer acts to absorb or remove any perspiration developing on the hand of the operative so as to avoid any possible slipping of the hand on the device.

The position of the device at the landmark position on the patient thus continues during the operation to accurately locate that position even when the operative moves away from the patient's chest for the lung inflation part of the process.

The disc is molded as an integral body from an opaque medical-type plastics material preferably in a light blue color. The disc is sufficiently rigid to maintain its general shape while deforming slightly to follow the patient's chest when the hand pressure is applied during the compression stroke. It must also have enough flexibility to avoid cracking or breaking under the forces involved. The smooth edges defined at the ribs ensure that there are no sharp edges for causing damage to the patient.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An aid for use in cardio-pulmonary resuscitation of a patient by a medical operative comprising a thin disc member which is sufficiently rigid to maintain its general shape while deforming slightly to follow the patient's chest when hand pressure is applied during the compression stroke of CPR having a substantially planar lower surface, activatible adhesive means on said lower surface of a type suitable for attachment of the disc member to the patient's skin, the disc member having an upper surface sized to receive the palm area of the operative's hand, moisture absorption means on the upper surface and a raised rim at least partly surrounding the upper surface.

2. The invention according to claim 1 wherein the raised rim extends fully around the periphery of the upper surface.

3. The invention according to claim 1 wherein the rim at a forward edge of the upper surface provides an increased extent of surface acting to raise fingers of the operative from the skin of the patient.

4. The invention according to claim 3 wherein the rim at the forward edge is of increased lifting effect relative to the rim at a rearward edge thereof.

5. The invention according to claim 3 wherein the rim at the front and rear edges is higher than the rim at side edges.

6. The invention according to claim 1 wherein the adhesive means includes a covering layer which can be removed manually to activate the adhesive means for engagement with the patient's skin.

7. The invention according to claim 1 wherein said disc member comprises a plastics member molded integrally to form said upper and lower surfaces and said raised rim.

8. The invention according to claim 7 wherein said moisture absorption means is molded integrally in said plastics material.

9. The invention according to claim 1 wherein said moisture absorption means comprises a layer of a sponge material applied onto the disc member on said upper surface thereof.

10. The invention according to claim 1 wherein the disc member comprises a thin rigid body defining said upper and lower surfaces which lie substantially parallel and spaced by a distance sufficient merely to provide rigidity of the disc member.

* * * * *